US005408074A

United States Patent [19]

Warmbier et al.

[11] Patent Number: 5,408,074

[45] Date of Patent: Apr. 18, 1995

[54] APPARATUS FOR THE SELECTIVE CONTROL OF HEATING AND IRRADIATION OF MATERIALS IN A CONVEYING PATH

[75] Inventors: Bernd Warmbier, Helmslingen; Hartmut Riedel, Stemwede; Werner Lautenschläger, Leutkirch/Allgäu, all of Germany

[73] Assignee: Oscar Gossler KG (GmbH & Co.), Reinbek bei Hamburg, Germany

[21] Appl. No.: 84,205

[22] PCT Filed: Nov. 5, 1992

[86] PCT No.: PCT/EP92/02537

§ 371 Date: Jul. 2, 1993

§ 102(e) Date: Jul. 2, 1993

[87] PCT Pub. No.: WO93/09647

PCT Pub. Date: May 13, 1993

[30] Foreign Application Priority Data

Nov. 5, 1991 [DE] Germany ..... 41 36 416.3

[51] Int. Cl.[6] ..... H05B 6/78

[52] U.S. Cl. ..... 219/701; 219/710; 219/759

[58] Field of Search ..... 219/10.55 A, 10.55 F, 219/10.55 R, 10.55 E, 10.55 D, 700, 701, 759, 710

[56] References Cited

U.S. PATENT DOCUMENTS

| | | | |
|---|---|---|---|
| 3,277,580 | 10/1966 | Tooby | 219/10.55 A |
| 3,474,209 | 10/1969 | Parker | 219/10.55 A |
| 3,624,335 | 11/1971 | Dench | 219/10.55 A |
| 3,665,141 | 5/1972 | Schiffmann et al. . | |
| 3,805,009 | 4/1974 | Sweet . | |
| 3,851,132 | 11/1974 | Van Koughnett | 219/10.55 A |
| 3,895,008 | 4/1974 | Kessler et al. . | |
| 3,983,356 | 9/1976 | Jurgensen | 219/10.55 A |
| 4,045,638 | 8/1977 | Chiang et al. | 219/10.55 A |
| 4,307,277 | 12/1981 | Maeda et al. | 219/759 |
| 4,406,937 | 9/1983 | Soulier . | |
| 4,570,045 | 2/1986 | Jeppson . | |
| 4,608,261 | 8/1986 | Mackenzie | 219/10.55 A |
| 4,687,895 | 8/1987 | Chitre et al. | 219/10.55 A |
| 4,687,937 | 8/1987 | Aagano et al. . | |
| 4,822,966 | 4/1989 | Matsubara | 219/10.55 F |
| 4,866,231 | 9/1989 | Schneider | 219/10.55 A |
| 5,019,680 | 5/1991 | Morino et al. | 219/10.55 F |

FOREIGN PATENT DOCUMENTS

| | | | |
|---|---|---|---|
| 0036362 | 9/1981 | European Pat. Off. . | |
| 0113900 | 7/1984 | European Pat. Off. . | |
| 3224114 | 12/1983 | Germany . | |
| 52-30938 | 3/1977 | Japan | 219/759 |
| 52-30939 | 3/1977 | Japan | 219/759 |
| WO85/04070 | 9/1985 | WIPO . | |
| WO86/01065 | 2/1986 | WIPO . | |

*Primary Examiner*—Philip H. Leung

*Attorney, Agent, or Firm*—Fitzpatrick, Cella, Harper & Scinto

[57] ABSTRACT

The invention relates to an arrangement for microwave radiation of materials, in particular of the starting materials for ceramic materials, alloys etc., having a conveying path that is defined at least in part by a trough or pipe arrangement, the wall of which has a specific microwave-absorption capacity, a resonator surrounding at least a length of the wall, and at least one generator for generating the microwave radiation. In order to enable adjustment of the heating and the radiation dosing of the microwave-treated materials independently of one another, it is proposed according to the invention that the wall of the trough or pipe arrangement (1; 9.1 to 9.3) has different microwave-absorption properties along its length.

21 Claims, 1 Drawing Sheet

APPARATUS FOR THE SELECTIVE CONTROL OF HEATING AND IRRADIATION OF MATERIALS IN A CONVEYING PATH

BACKGROUND OF THE INVENTION

1. Field of the Invention

The invention relates to an apparatus for microwave irradiation of materials.

2. Description of Related Art

From DE-OS 32 24 114 an apparatus of this kind is known which serves for heating liquids and in particular for cracking used oil that flows through pipelines including a cracking pipe of oxide ceramic or of similar non-polar materials and is heated by microwave irradiation up to temperatures of about 700° C. and is thereby fractionated. To generate the microwave radiation a number of so-called power packets are arranged along the cracking pipe.

This known apparatus is disadvantageous insofar as its use is restricted to the heating of polar liquids by direct irradiation thereof with microwaves, and a change in the degree to which the liquid is heated cannot be effected without a corresponding change the radiation dose applied to the liquid.

Described in U.S. Pat. No. 3,805,009 is an apparatus for acting on foodstuffs with microwaves, during frying in an oil bath. In this known apparatus the foodstuffs are conveyed on a horizontal circulating conveyor belt under a microwave application chamber through the provided heating zone. A plurality of antennas in the form of rods extending transversely are provided in the middle region of the application chamber. Arranged before and after the antennas in the application chamber are material layers arranged one above the other of which the upper layer consists of a microwave absorbing material, while the lower layer consists of a dielectric material such as Pyroceran. The purpose of the layered arrangement is to reduce or restrict the application of microwaves to the foodstuffs.

SUMMARY OF THE INVENTION

It is an object of the invention to enable independent adjustment of the heating and the radiation dosing of microwave-treated materials.

This object is achieved by means of a trough or pipe arrangement, a resonator surrounding at least a length of the wall and at least one generator for generating the microwave radiation, with the wall of the trough or pipe arrangement having microwave-absorption properties that are different at different locations along the length of the pipe.

The apparatus according to the invention makes it possible to provide, along the throughput direction, any desired ratio of the proportion of microwave radiation that is absorbed by the wall and serves to heat the wall or to heat the additional material and thus to indirectly heat the material to be treated, and the remaining proportion that penetrates the wall and/or the additional material and enters the material to be treated.

For this purpose, two parameters are available which, in association with a third parameter and by corresponding mutual adjustment, enable selective adjustment of the heating and of the radiation dosing of microwave treated materials independently of one another. The third parameter is the adjustable radiation power of the microwaves generated by the generator concerned. It is therefore possible, for example, to heat to a greater extent polar as well as non-polar materials by increasing the radiation power together with the microwave-absorption by the wall, and by corresponding adjustment of these two parameters it can be achieved that the wall absorbs more, in an amount corresponding to the increase in the radiation power, i.e. to such an extent that as a further parameter the proportion of radiation passing through the wall and thus the radiation dosing of the material remain unchanged. In a corresponding manner the radiation dosing can be changed whilst a constant temperature is maintained. It is clearly also possible to change the heating and the radiation dosing simultaneously in a selective manner.

The microwave-absorption properties of the wall can be changed not only by the selection of the microwave-absorbing capacity determined by the material composition of the wall, but also, in the case of a microwave absorbing wall, by its thickness.

The ability to selectively change the relationship between the heating and the radiation dosing is advantageous inasmuch as, according to the latest state of knowledge, structural changes in materials are caused by microwave irradiation and thus with appropriate selection of said relationship between the heating and the radiation dosing, chemical processes can be optimised and in particular materials can be changed with regard to their molecular and/or crystal structure.

The apparatus according to the invention is therefore also especially suitable for the manufacture of insulators, semiconductors, cermets, superconductors and other components whose qualities can be influenced by changing their crystal structure. For example, by using microwave-permeable walls, the structure of non-polar materials can be changed without heating and the structure of polar materials can be changed with simultaneous heating, whilst a wall with a correspondingly high microwave-absorption capacity and if necessary a correspondingly large wall thickness enables heating of polar as well as non-polar materials without causing structure changes. Structure changes with simultaneous heating can be effected in polar and non-polar materials in accurately coordinated relationship by using walls that are correspondingly partly microwave-permeable or partly microwave-absorbing, if necessary having corresponding wall thicknesses, by means of microwaves with corresponding radiation power.

If non-polar materials are to be heated and, for example, are to be irradiated with the highest intensity of microwaves, so that an almost completely microwave-permeable wall is used, according to claim 2 of the invention a device is provided before the conveyor path, by means of which additional materials having a high microwave-absorbing capacity can be added to the materials to achieve direct heating thereof. If separation is possible these additional materials can be removed after microwave irradiation has been completed.

BRIEF DESCRIPTION OF THE DRAWINGS

Two exemplary embodiments of the invention will now be described in more detail with reference to the drawings, in which.

DETAILED DESCRIPTION OF THE PREFERRED EMBODIMENT

Figure 1:
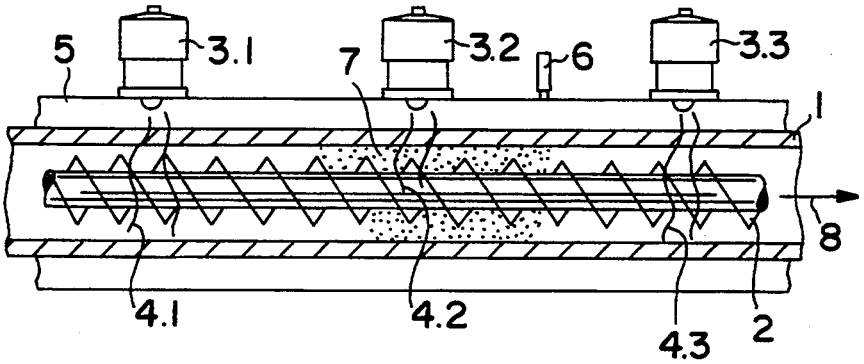
FIG. 1 shows a schematic representation of the first exemplary embodiment of the apparatus according to the invention for chemically transforming a material.

The apparatus shown in FIG. 1 includes a conveying path defined by a pipe 1, a screw conveyor 2 that is rotatably mounted in the pipe and driven by a drive (not shown), a plurality of, for example three, generators 3.1, 3.2 and 3.3 that are of conventional construction and have controllable power for generating microwave rays 4.1, 4.2 and 4.3, and a resonator 5 likewise of conventional construction that is formed as a metal chamber surrounding a length of the pipe 1 and serves to increase the intensity and density of the microwaves 4.1–4.3 generated by the generators 3.1–3.3 and fed in through waveguides (not shown), and to prevent the microwaves from escaping to the surroundings. The arrangement furthermore includes sensors for control of the process, such as for example temperature sensors 6 (of which only one is shown) for measuring the temperature of the pipe 1.

The pipe 1 consists entirely of ceramic with the addition of an electrically and/or magnetically conductive substance (e.g. C, SiC, metal etc.) the percentage proportion of which varies so that the pipe has a microwave-absorption capacity that gradually changes along its length: the pipe sections (indicated by widely spaced diagonal lines) associated with the two end regions of the resonator 5 are almost completely microwave-permeable, whilst the pipe section (indicated by closely spaced diagonal lines) associated with the middle region absorbs microwaves. To increase microwave absorption the middle pipe section may, if necessary, have a larger wall thickness than the neighbouring pipe sections.

The apparatus shown in FIG. 1 can be used to perform a chemical process with selected transformation of a, for example, polar material 7 that is, for example, to be heated in the three successive pipe sections to different temperatures with a constant radiation dose. The material 7 is supplied as a granulate to the pipe 1 in a manner not shown, and by means of the rotating screw conveyor 2 is transported in the transporting direction 8 through the pipe sections in the region of the resonator 5. It first arrives in the pipe section in the left region (in FIG. 1) of the resonator 5 and is there heated directly, until the material's melting temperature has been reached, by the microwave rays 4.1 that are generated by the generator 3.1 and which almost all pass through the pipe wall. The material 7 is hereby subjected to a radiation dose that corresponds to the power of the microwave radiation 4.1. In the following pipe section, in the middle region of the resonator 5, further heating of the material 7 occurs by means of microwave radiation 4.2 generated by the generator 3.2 with corresponding higher power in comparison to generator 3.1. The pipe wall has a microwave absorption capacity (if necessary also wall thickness) that is so adapted to this higher radiation power that the wall allows the same proportion of radiation to pass through as the pipe wall in the preceding pipe section and thus causes the same radiation dose and the same direct heating of the material 7. The remaining proportion of radiation, that is absorbed by the pipe wall and heats the wall, causes further heating of the material 7 until the temperature necessary for transformation thereof is reached. After transformation is completed the material 7 arrives in the subsequent third pipe section. As the microwave-absorption properties of the wall of this pipe section and the power of the associated generator 3.3 are the same as those in the first pipe section associated with the generator 3.1, the material 7 cools in this third pipe section, with the same radiation dose, until the melting temperature is reached. More uniform heating of the material 7 can be achieved by using a screw conveyor 2 of a microwave-absorbing substance.

Figure 2:
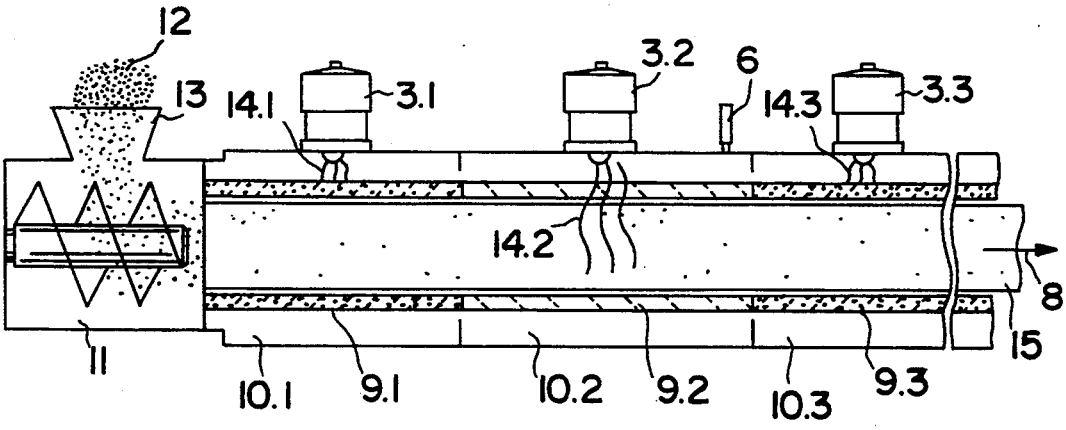
FIG. 2 shows a schematic representation of the second exemplary embodiment of the apparatus according to the invention for the manufacture of ceramic components.

The apparatus shown in FIG. 2 differs from that shown in FIG. 1 by the use of a pipe that comprises a plurality of (e.g. three) separate pipe sections 9.1, 9.2, and 9.3, a resonator that likewise comprises a plurality of sections 10.1 to 10.3, and a conventional extruder 11 (indicated only in outline) arranged before the pipe 9.1 to 9.3 instead of the screw conveyor located in the pipe. Associated with each pipe section 9.1–9.3 and each resonator section 10.1–10.3 is a respective generator 3.1 to 3.3 as in FIG. 1.

The pipe wall of the middle pipe section 9.2 consists of almost entirely microwave-permeable ceramic, while the two neighbouring pipe sections 9.1 and 9.3 have, through the addition of, for example, carbon or silicon carbide (SIC), a corresponding microwave-absorption capacity. If necessary the wall thickness and thus the microwave absorption can be increased.

The apparatus shown in FIG. 2 can be used for the manufacture of components of ceramic materials having a crystal structure that is influenced by microwave radiation of a certain power. For this purpose a ductile mixture 12 of the starting materials of these ceramic materials is supplied through a funnel opening 13 of the extruder 11 and transported in the transporting direction 8 by its screw conveyor through the pipe 9.1–9.3. Thereby, the mixture 12 first arrives in the pipe section 9.1 neighbouring the extruder 11 and is there heated by the pipe wall, that is heated by the proportion of microwave radiation 14.1 generated by the generator 3.1 absorbed thereby, to a temperature that lies above the crystallisation point of the ceramic material. A remaining proportion of microwave radiation 14.1, passing through the pipe wall, has as a result of appropriate adjustment of the generator 3.1 the same, specific power necessary for achieving the desired influence on the crystal structure as the total microwave radiation 14.2 generated by the subsequent generator 3.2. In the adjoining pipe section 9.2 cooling of the mixture 12 takes place as a result of its non-polar quality and thus crystallisation thereof occurs. This crystallisation is influenced in the desired manner by the microwave radiation 14.2 that is generated with less power by the generator 3.2 and which almost all passes through the microwave-permeable pipe wall. The radiation dosage of the mixture 12 is the same as in the preceding pipe section 9.1. In the following pipe section 9.3, that is longer than the first pipe section 9.1, the mixture 12 is heated by means of the microwave radiation 14.3 generated by the generator 3.3 with a corresponding higher power until it reaches baking temperature and is baked. Heating occurs indirectly by way of the pipe wall, the microwave-absorption capacity of which and if necessary the wall thickness of which are adapted so that the proportion of radiation absorbed thereby is sufficient for reaching baking temperature, and the remaining proportion of radiation causes the same radiation dosage of the mixture 12 as in the two preceding pipe sections 9.1 and 9.2. The power of the generator 3.3 is thus greater than that of the generator 3.1, whilst the generator 3.2 has the least power, which determines the radiation dosage of the mixture 12. The excess output of the two generators 3.1 and 3.3 serves to heat the mixture 12 to the relevant temperatures. After baking is complete the finished ceramic material is expelled as an endless column 15 from the free end of the pipe section 9.3.

Naturally, materials of consistency different from that described above, for example in liquid or suspended form, can be treated by the arrangement according to the invention, with appropriate conveying means, such as for example rotating pipes, conveyor belts etc. The microwaves can also be pulsed to influence the structure of the materials.

We claim:

1. An apparatus for microwave irradiation of materials, said apparatus comprising a trough or pipe which defines a materials conveying path and which is formed by a wall along the length of which materials to be heated and irradiated may pass, a resonator surrounding at least a portion of the length of the wall, at least one generator for generating microwave radiation within said resonator, said wall of the trough or pipe having, in successive regions along its length, microwave-absorption properties that are different from the microwave absorption properties in adjacent regions and a conveyor for moving materials along said conveying path.

2. An apparatus according to claim 1, characterised in that for the purpose of direct microwave heating of materials, a device for supplying to the material additional materials having a high microwave-absorption capacity is provided before the conveying path.

3. An apparatus according to claim 1, characterised in that the trough or pipe arrangement is arranged horizontally.

4. An apparatus according to claim 1, characterised in that the wall has a material composition that is different at different regions along its length.

5. An apparatus according to claim 1, characterised in that the wall has a thickness that is different at different regions along its length.

6. An apparatus according to claim 1, characterised in that the microwave radiation generated by the generator is variable.

7. An apparatus according to claim 1, characterized in that the microwave radiation generated by the generator is so different in different regions along the length of the trough or pipe that the temperature throughout said different regions of the trough or pipe is constant.

8. An apparatus according to claim 1, characterised in that temperature sensors are provided for measuring the temperature of the trough or pipe.

9. An apparatus according to claim 1, characterised in that the pipe is of ceramic with the addition of a conductive substance.

10. An apparatus according to claim 1 characterised in that the trough or pipe wall absorbs microwaves in a middle region thereof and, in adjacent regions on opposite sides of this middle region, is almost completely microwave-permeable.

11. An apparatus according to claim 1, characterised in that the trough or pipe wall has a larger wall thickness in a middle region than in regions on opposite sides of this middle region.

12. An apparatus according to claim 1, characterised in that a plurality generators are arranged in successive regions along the length of the trough or pipe.

13. An apparatus according to claim 12, characterised in that the radiation powers of the generators differ.

14. An apparatus according to claim 1, characterised in that the wall of said trough or pipe comprises a plurality of separate pipe sections.

15. An apparatus according to claim 14, characterised in that said plurality is three, the middle pipe section consists of microwave-permeable ceramic, whilst two neighbouring pipe sections have a microwave-absorption capacity.

16. An apparatus according to claim 1, characterised in that an associated microwave generator is provided at each of different sections along the length of said trough or pipe.

17. An apparatus according to claim 1, characterised in that a rotatable screw conveyor is arranged in the trough or pipe.

18. An apparatus according to claim 17, characterised in that the screw conveyor is of microwave-absorbing material.

19. An apparatus according to claim 1, characterised in that an extruder is arranged before the trough or pipe.

20. An apparatus according to claim 1, wherein the microwave absorption properties of said wall change gradually along its length.

21. An apparatus according to claim 1, wherein said successive regions comprise adjacent pipe sections and wherein the microwave-absorption properties of each pipe section are different from those in the next adjacent pipe sections.

* * * * *